US009251927B2

(12) United States Patent
Kim et al.

(10) Patent No.: US 9,251,927 B2
(45) Date of Patent: Feb. 2, 2016

(54) CABLE HAVING REDUCED TANGLE ABILITY

(71) Applicants: JOINSET CO., LTD., Ansan-si, Kyeonggi-do (KR); Sun-Ki Kim, Gunpo-si (KR)

(72) Inventors: Sun-ki Kim, Gunpo-si (KR); Ho-Soung Sohn, Ansan-si (KR)

(73) Assignees: Joinset Co., Ltd. (KR); Sun-Ki Kim (KR)

( * ) Notice: Subject to any disclaimer, the term of this patent is extended or adjusted under 35 U.S.C. 154(b) by 255 days.

(21) Appl. No.: 13/953,851

(22) Filed: Jul. 30, 2013

(65) Prior Publication Data

US 2014/0041897 A1 Feb. 13, 2014

(30) Foreign Application Priority Data

Aug. 13, 2012 (KR) ..... 10-2012-0088257
May 30, 2013 (KR) ..... 10-2013-0062117

(51) Int. Cl.
*H01B 7/04* (2006.01)
*H04R 1/10* (2006.01)

(52) U.S. Cl.
CPC ..... *H01B 7/04* (2013.01); *H04R 1/1033* (2013.01)

(58) Field of Classification Search
USPC .... 174/110 R, 113 R, 117 R, 120 R, 120 SR, 174/121 R, 121 SR, 112
See application file for complete search history.

(56) References Cited

U.S. PATENT DOCUMENTS 2,313,234 A * 3/1943 Gavitt ..... 174/120 SR
2,992,292 A * 7/1961 Brown ..... 174/112
3,217,083 A * 11/1965 Gore ..... 174/25 R
4,075,421 A * 2/1978 McCullough ..... 174/120 SC
4,722,959 A * 2/1988 Inoue ..... C08K 3/22 174/110 PM
5,306,766 A * 4/1994 Omura et al. ..... 524/588
5,317,051 A * 5/1994 Harashige ..... C08K 3/22 524/310
5,342,913 A * 8/1994 Takago ..... C08L 83/04 528/15
5,428,096 A * 6/1995 Fukunaga ..... 524/440
6,258,522 B1 * 7/2001 Mariotti et al. ..... 430/567
6,294,636 B1 * 9/2001 Baba et al. ..... 528/24
6,781,062 B2 * 8/2004 Kuss ..... H01B 7/295 174/120 R
7,244,890 B2 * 7/2007 Aisenbrey ..... 174/36
7,256,347 B2 * 8/2007 Gustavsson ..... 174/74 R
7,750,242 B2 * 7/2010 Fukuchi et al. ..... 174/110 R
7,989,700 B2 * 8/2011 Eshima ..... H01B 7/1865 174/103

(Continued)

FOREIGN PATENT DOCUMENTS

EP 0593111 A1 9/1993
JP 05-005062 * 1/1993 ..... C08L 83/07

(Continued)

*Primary Examiner* — William H Mayo, III

(74) *Attorney, Agent, or Firm* — Park & Associates IP Law, P.C.

(57) ABSTRACT

A cable including a metal core for transmitting an electrical signal, an insulating coating surrounding the metal core, and an elastic coating layer surrounding the insulating coating. The elastic coating layer is formed from a liquid polymer in which powder is mixed, and the liquid polymer is cured to form the elastic coating layer surrounding the insulating coating, wherein the elastic coating layer has a frictional coefficient less than that of the insulating coating, a hydrophobic property greater than that of the insulating coating, and a thickness less than that of the insulating coating.

32 Claims, 3 Drawing Sheets

(56) References Cited

U.S. PATENT DOCUMENTS

| | | | | |
|---|---|---|---|---|
| 2001/0014714 | A1 | 8/2001 | Amarasekera et al. | |
| 2004/0044121 | A1 * | 3/2004 | Kadlec et al. | 524/588 |
| 2004/0132907 | A1 * | 7/2004 | Nakamura | C08F 297/04 252/88 |
| 2006/0004144 | A1 * | 1/2006 | Kimura | C08L 23/06 525/198 |
| 2006/0068201 | A1 * | 3/2006 | Alexander et al. | 428/357 |
| 2009/0292061 | A1 * | 11/2009 | Kitano | C08F 8/00 524/505 |
| 2011/0079427 | A1 * | 4/2011 | Powale et al. | 174/72 A |
| 2011/0110552 | A1 * | 5/2011 | Pang | H04R 1/1033 381/374 |
| 2011/0182460 | A1 * | 7/2011 | Aase | B29C 43/203 381/384 |
| 2012/0328144 | A1 * | 12/2012 | Dugger | H04R 1/1033 381/384 |

FOREIGN PATENT DOCUMENTS

| | | | | |
|---|---|---|---|---|
| JP | 2003-100149 | * | 4/2003 | H01B 3/46 |
| JP | 2005-239929 | A | 9/2005 | |
| JP | 2010-251134 | A | 11/2010 | |
| JP | 2011-34834 | A | 2/2011 | |

* cited by examiner

CABLE HAVING REDUCED TANGLE ABILITY

REFERENCE TO RELATED APPLICATIONS

This application claims the priority benefit of Korean Patent Application No. 10-2012-0088257 filed on Aug. 13, 2012 and Korean Patent Application No. 10-2013-0062117 filed on May 30, 2013, the entire contents of which are incorporated herein by reference.

FIELD OF THE INVENTION

The present invention relates to a cable, and more particularly, to a cable of which the outermost surface is reduced in frictional coefficient to prevent the cable from being easily tangled and to easily untangle tangled cable even though the cable is tangled.

Also, the present invention relates to a cable that is not easily crumpled and is easily restored in its original state after being crumpled, as well as has superior scratch resistance, resistance to foreign substances such as dusts, and contamination resistance.

BACKGROUND OF THE INVENTION

Signal transmission cables for transmitting/receiving electrical signals generated in acoustic systems or imaging systems may be connected for use with earphones, headphones, speakers, or image display devices. Here, cables used for earphones, headphones, measuring instruments, and the like may generally have superior flexibility.

As well-known, such a cable includes a metal conductor for transmitting a signal and an insulating coating for protecting the metal conductor. Here, an insulating jacket may be additionally disposed on the insulating coating. In addition, to reduce the effects of surrounding electromagnetic noises and transmission losses, a metal shield and an insulating jacket may be disposed on the insulating coating.

Typically, an insulating coating is formed of an insulating polymer resin. The insulating polymer resin may be extruded onto the metal conductor by using an extruder to manufacture the insulating polymer coating. Well-known polyvinyl chloride (PVC)-based and non-PVC-based thermoplastic resins or thermosetting rubber such as silicone rubber may be selectively used as the insulating polymer resin used for the insulating polymer coating or the insulating jacket.

In general, typical PVC-based or non-PVC-based thermoplastic resins may be relatively inexpensive and easy for extrusion, but have poor elastic and restoring force. Typical silicone rubber-based thermosetting rubber may have elasticity and flexibility, but have relatively high frictional coefficient, low hardness, and high manufacturing costs.

As described above, in the insulation coating and insulating jacket constituting the conventional cable, it may be difficult to reduce a frictional coefficient and increase a hydrophobic property on an outer surface of the cable and by using polymers corresponding to the insulating coating and the insulating jacket.

As a result, since the insulating coat or insulation jacket that forms the outermost surface of the conventional cable has a relatively low surface frictional coefficient, the conventional cable has problems as follows:

a) The cable may be easily tangled, and it may be difficult to untangle the tangled cable.

b) If the cable moves in contact with a user's skin, the user may not feel good, and the user' skin may be damaged by surface friction.

c) When the cable contacts an external object, noises may occur by friction.

Also, since the insulating coating or insulating jacket has relatively low surface hardness, the cable may be easily damaged by external friction or a facing object.

Also, since the insulating coating or insulating jacket has relative low elastic and restoring force, if the cable is tangled once, the cable may not be easily untangled.

Also, since the insulation coating or insulating jacket has a low hydrophobic property, foreign substances may be easily attached on a surface of the cable. In addition, the cable may be easily contaminated. For example, if the foreign substances are attached once, the foreign substances may not be easily detached. Also, the cable may easily scribble by writing instruments such as ballpoint pens and the like, the scribbling marks may not be easily removed.

Also, since the surface of the insulating coating or insulating jacket has a low hydrophobic property and an absorbable property, the cable may be easily swelled or discolored by salt water or sweat.

Also, the surface of the insulating coating or insulating jacket may be easily discolored by ultraviolet (UV) rays.

Also, since the surface of the insulating coating or insulating jacket does not have a gloss, the cable may not have an elegant color.

For example, when a cable including an insulating coating or insulating jacket formed of a flexible PVC-based or non-PVC-based resin or a flexible PU-based synthetic resin is applied to earphones of smart phones, if considering a feature in which the earphones are frequently put in/out a pocket, the earphones may be easily tangled because the earphones have a relatively high frictional coefficient and low elasticity. Also, if the earphones are tangled once, it may be not easy to untangle the tangled earphones and restore the crumpled portion to its original state. Also, since the earphones have a low hardness, the earphones may be easily damaged. In addition, since the earphones have a low hydrophobic property, the earphones may be easily contaminated by foreign substances such as ballpoint pens and the like.

Also, when the earphones rub against clothes, friction sound may occur. Also, when the earphones contact a user's neck, the earphones may be easily swelled or discolored by sweat. Also, when the earphones contact a face, cosmetics cosmetized on the face may be easily stained on the earphones. Also, if the earphones are excessively exposed to the sun, the earphones may be easily changed in color, and it may be difficult to realize an elegant outer appearance and a high gloss.

The above-described problems may equally occur in cables for earphones, frequently movable cables for measuring instruments or robots, or cables for computers.

SUMMARY OF THE INVENTION

Therefore, an object of the present invention is to provide a cable that is not easily tangled and is easily untangled even though the cable is tangled.

Another object of the present invention is to provide a cable that is easily restored in its original shape after being crumpled.

A further another object of the present invention is to provide a cable that provides a smooth feeling when contacting a user's skin.

A further another object of the present invention is to provide a cable of which a surface is not easily damaged by a facing object.

A further another object of the present invention is to provide a cable on which foreign substances are not easily attached on a surface thereof and are easily detached even though the foreign substances are attached.

A further another object of the present invention is to provide a cable of which a surface is not easily contaminated by foreign substances.

A further another object of the present invention is to provide an economical cable that has a low frictional coefficient, a high hydrophobic property, and superior elasticity.

A further another object of the present invention is to provide an economical cable having an improved heat-resistant temperature.

A further another object of the present invention is to provide a cable having minimized friction sound.

A further another object of the present invention is to provide a cable of which a surface is not easily discolored or deformed by foreign substances.

A further another object of the present invention is to provide an economical cable that has an elegant outer appearance and a high gloss.

According to an aspect of the present invention, there is provided a cable having reduced tangle ability, the cable including: a metal core for transmitting an electrical signal; an insulating coating surrounding the metal core, the insulating coating having flexibility; and a coating layer adhering cured to surround the insulating coating, the coating layer having flexibility and elasticity, wherein the insulating coating is impregnated into a liquid polymer in which powder is mixed, and the liquid polymer is cured so that the coating layer adheres to surround the insulating coating, and the coating layer has a frictional coefficient less than that of the insulating coating, a hydrophobic property greater than that of the insulating coating, and a thickness less than that of the insulating coating.

The liquid polymer after being cured may include synthetic rubber, and the synthetic rubber may include one of silicone-based rubber, urethane-based rubber, olefin-based rubber, and styrene-based rubber.

The powder may include a) one selected from first powder consisting of 3D cross-linked silicone powder, polymethyl methacrylate (PMMA) powder, ceramic powder, fluorine power, and monodispersed polystyrene, b) one selected from second powder consisting of mica powder, silica powder, glass powder, graphite powder, and alumina powder, or c) at least one of each of the first and second powder.

The first powder may have a sphere shape, and the second powder may have a flake shape.

The second powder may be coated with iron oxide or titanium dioxide.

The synthetic rubber may have a refractive index different from that of the second powder, and the cable may have a gloss due to the refractive index difference.

The coating layer may have a heat-resistant temperature greater than that of the insulating coating, and the coating layer may have hardness greater than that of the insulating coating.

The metal core may include one of a metal single wire and a metal stranded wire in which a plurality of metal single wires are twisted with each other.

The metal core may include a metal single wire on which an insulating layer is formed on an outer surface thereof by enamel coating or a metal stranded wire in which a plurality of metal single wires are twisted with each other.

One insulating coating may surround one metal core or a plurality of metal cores which are insulated from each other, or each of a plurality of insulating coatings may surround one metal core or each of a plurality of metal cores which are insulated from each other.

The metal core may be surrounded by an insulating thread, or the insulating thread may be parallely arranged adjacent to the metal core.

The coating layer may have electrical insulation or electrical semiconductivity.

The curing may include one of thermal curing and UV curing.

According to another aspect of the present invention, there is provided a cable having reduced tangle ability, the cable including: at least one metal core for transmitting an electrical signal; at least one insulating coating surrounding the metal core, the at least one insulating coating having flexibility; an insulating jacket surrounding the at least one insulating coating, the insulating jacket having flexibility; and an elastic coating layer adhering cured to surround the insulating jacket, the coating layer having flexibility, wherein the insulating jacket is impregnated into a liquid polymer resin in which powder is mixed, and the liquid polymer resin is cured so that the coating layer adheres to surround the insulating jacket, and the coating layer has a frictional coefficient less than that of the insulating jacket, a hydrophobic property greater than that of the insulating jacket, and a thickness less than that of the insulating jacket.

The cable may further include a metal shield surrounding the insulating coating between the insulating coating and the insulating jacket.

The insulating jacket may be formed by continuously extruding on the insulating coating or include a separate insulating tube, and the insulating tube may be fitted onto the insulating coating.

The coating layer may have a heat-resistant temperature greater than that of the insulating jacket, and the coating layer may have hardness greater than that of the insulating jacket.

The metal core may be provided in plurality, wherein the insulating coating may surround each of the metal cores or the metal cores at once, and the insulating jacket may surround the insulating coating at once.

The cable may include a cable for earphones exposed to the outside for use, a cable for measuring instruments, a cable for robots, or a cable for computers.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE INVENTION

Now, preferred embodiments of the present invention will be described in detail with reference to the accompanying drawings.

Figure 1:
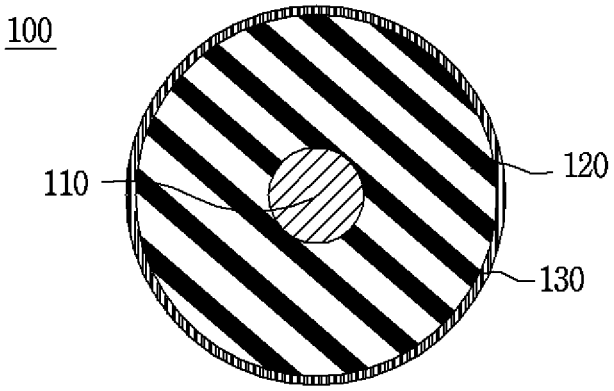
FIG. 1 is a view of a cable according to an embodiment of the present invention.

FIG. 1 is a view of a cable according to an embodiment of the present invention.

A cable 100 includes a metal core 110, an insulation coating 120 having flexibility and surrounding the metal core 110, and an elastic coating layer 130 having elasticity and flexibility and surrounding the insulating coating 120.

The cable 100 according to the present invention may be used for transmitting electrical signals or electricity. That is, the cable 100 may be used for electrically transmitting voices, images, data or electric power. For example, the cable 100 may be used in earphones, smart phones, computers, vacuum cleaners, robots, vehicles, motorcycles, or elevators. Particularly, a cable for earphones, which is exposed to the outside and used for frequently movable use, a cable for measuring instruments, a cable for robots, or a cable for computers should have superior flexibility and elasticity and have less of an effect on external environment change, and also may have an elegant outer appearance.

The metal core 110 may be a metal single wire formed of copper or a copper alloy having superior conductivity and flexibility or a metal stranded wire in which a plurality of metal single wires having a small diameter are twisted with each other. When the metal core 110 is provided as the metal stranded wire, each of metal single wires constituting the metal stranded wire may be formed of copper or a copper alloy.

Also, the metal core 110 may be surrounded by an insulating thread. Alternatively, an insulating thread may parallely arranged adjacent to the metal core 110 so that the metal core 110 has flexibility and is not easily snapped.

Also, when the metal core 110 is provided as the metal stranded wire, each of metal single wires constituting the metal stranded wire may have a diameter of about 0.01 mm to about 0.1 mm so that the metal signal wire has flexibility. However, the present invention is not limited thereto.

Here, the number of metal single wires constituting the metal stranded wire may be determined in consideration of a diameter, allowable current, and flexibility of the metal single wire. The metal stranded wire may have a gauge of about AWG (American Wire Gauge) 20 to about AWG 40. However, the present invention is not limited thereto.

When the metal core 110 is provided as the metal single wire, the single wire may have allowable diameter, current, and flexibility thereof.

Although not shown, when the metal core 110 is provided as the metal single wire, an insulating material such as enamel may be thinly coated on an outer surface of the metal single wire to form an insulating layer. Also, when the metal core 110 is provided as the metal stranded wire, an insulating material such as enamel may be thinly coated on an outer surface of each of the metal single wires to form an insulating layer. Also, a plurality of existing enamel wires may be twisted with each other to constitute the metal stranded wire.

As described above, since the metal core 110 is thinly coated with the enamel, the metal core 110 may have insulation. Thus, a product including the metal core 110 may be applicable to an earphone cable of which a diameter is relatively small, and flexibility is required.

Although the cable 100 includes one metal core 110 in this embodiment, the present invention is not limited thereto. For example, the cable 100 may include a plurality of metal cores. This structure will be described later.

Also, although the cable 100 includes one insulating coating 120 surrounding one metal core 110 in this embodiment, the present invention is not limited thereto. For example, the cable 100 may include one insulating coating surrounding a plurality of metal cores or a plurality of insulating coatings respectively surrounding a plurality of metal cores. This structure will be described later.

The cable 100 is not specifically limited to the shape of a section thereof. Like this embodiment, the cable 100 may have a circular, oval, or dumbbell shape in section.

The insulating coating 120 may be formed of thermoplastic polymer resin, thermoplastic rubber, or thermosetting rubber having electric insulation. Thus, the insulating coating 120 may have flexibility. Also, the insulating coating 120 may be formed on the metal core 110 through an extrusion process. That is, grains of an insulating polymer resin corresponding to the insulating coating 120 may be continuously extruded on the metal core 110 by using an extruder to form the insulating coating 120.

Since technologies for manufacturing the metal core 110 and the insulating coating 120, and a technologies for forming the insulating coating 120 on the metal core 110 are well-known, their detailed descriptions will be omitted.

The coating layer 130 may selectively have following conditions, and also an advantage according to the selected condition.

a) The coating layer 130 has a frictional coefficient less than that of the insulating coating 120.

Thus, the cable 100 may not be easily tangled and also be easily untangled even though the cable 100 is tangled. Also, the cable 100 may be easily spread even though the cable is crumpled. Also, foreign substances may not be easily attached on the surface of the cable 100 and may be easily detached even though the foreign substances are attached. Particularly, since the coating layer 130 forming the outermost surface of the cable 100 has a low frictional coefficient, if the cable 100 contacts a user's skin, the cable 100 may provide smooth feeling to a user and thus not give the user to an unpleasant feeling. In addition, when the cable 100 contacts the user' skin, the skin may not be easily wounded by the cable 100. Also, when the cable 100 contacts clothes, friction sound due to the friction with the clothes may be minimized.

b) The coating layer 130 has a hydrophobic property greater than that of the insulating coating 120.

Thus, since the coating layer 130 has a relatively high hydrophobic property, foreign substances may not be easily attached on the surface of the coating layer 130 and may be easily detached even though the foreign substances are attached. Also, the coating layer 130 may not be easily contaminated by a liquid material such as ink. Also, since the coating layer 130 does not well absorb sweat containing salt or other solutions, the cable 100 may not be easily discolored or deformed.

c) The coating layer 130 has a thickness less than that of the insulating coating 120 and a heat-resistant temperature greater than that of the insulating coating 120.

Thus, since it takes a relatively short time to perform a coating process because the coating layer 130 has a thickness less than that of the insulating coating 120, the coating layer 130 having a relatively high heat-resistant temperature may be efficiently coated on the insulating coating 120 having a relatively low heat-resistant temperature. Also, the cable 100 may have improved heat-resistance by the coating layer 130 having the superior heat-resistance.

d) The coating layer 130 has flexibility and elasticity.

Thus, when the cable 100 is crumpled, the cable 100 may be easily spread. Also, the cable 100 may partially absorb an external impact.

e) The coating layer 130 has hardness greater than that of the insulating coating 120.

Thus, when the cable 100 contacts a contact object, the cable 100 may not be easily damaged. Also, since the cable 100 increases in tensile strength, the cable may extend in life-cycle.

f) The coating layer 130 may have a high gloss.

Thus, the outermost surface of the cable 100 may have superior gloss and reflected luminance.

Since the insulating coating 120 is impregnated into a liquid polymer containing powder, and then the liquid polymer is cured to form the coating layer 130, the coating layer 130 may be attached to the insulating coating 120 while surrounding the insulating coating 120. Here, after the insulating coating 120 is impregnated into the liquid polymer containing the powder, the liquid polymer may be cured in a state where the insulating coating 120 stands up so that the coating layer 130 has a uniform thickness.

To decrease the frictional coefficient of the coating layer 130 and increase the hydrophobic property of the coating layer 130, or improve a gloss of the coating layer 130, at least one powder may be mixed into the liquid polymer.

For example, to decrease the frictional coefficient of the coating layer 130 and increase the hydrophobic property of the coating layer 130, at least one selected from first powder consisting of 3D cross-linked silicone powder, polymethyl methacrylate (PMMA) powder, ceramic powder, fluorine power, and monodispersed polystyrene may be mixed into the liquid polymer.

Also, to increase the frictional coefficient of the coating layer 130, increase the hydrophobic property of the coating layer 130, and improve the gloss and reflected luminance of the coating layer 130, at least one selected from second powder consisting of mica powder, silica powder, glass powder, graphite powder, and alumina powder may be mixed into the liquid polymer.

Also, at least one selected from the first powder and at least one selected from the second powder may be mixed at once.

Here, the coating layer 130 may decrease in frictional coefficient, increase in hydrophobic property, and be improved in mechanical strength by anyone in the first powder and the second powder. Particularly, the first powder may have an advantage for decreasing the frictional coefficient of the coating layer 130 and increasing the hydrophobic property of the coating layer 130, and the second powder may have an advantage for improving the gloss of the coating layer 130. However, the present invention is not limited thereto.

The liquid polymer after being cured may be thermoplastic synthetic rubber or thermosetting synthetic rubber which has elasticity. For example, the synthetic rubber may include one of silicone-based rubber, urethane-based rubber, olefin-based rubber, and styrene-based rubber which has elasticity. However, the present invention is not limited thereto.

As one example of a manufacturing process, to increase the frictional coefficient and increase the hydrophobic property, at least one of the first powder as a filler may be mixed by about 1 wt % to about 25 w % into a liquid silicone rubber base to form the coating layer 130.

In regard to a content of the first powder, if the first powder content to weight is too much, manufacturing costs may significantly increase, an outer appearance may not be smooth, and the elasticity may be deteriorated. On the other hand, if the first powder content to weight is too less, it may be difficult to decrease the frictional coefficient and increase the hydrophobic property and the hardness.

The meaning of the above-described content may be construed in consideration that a main reason of the mixing of the first powder is for decreasing the frictional coefficient of the coating layer 130 and increasing the hydrophobic property of the coating layer 130. That is, the first powder may be mixed because it is difficult to decrease the frictional coefficient by using only the polymer (for example, silicone rubber) constituting the coating layer 130. If the object of the present invention is achieved by using only the polymer constituting the coating layer 130, the first powder content may be significantly reduced, or the first power may be excluded.

A silicone oil or solvent for adjusting density, silica powder, a curing agent, a coloring agent, and the like may be mixed into the liquid silicone rubber base. To decrease the frictional coefficient and increase the hydrophobic property, liquid silicone rubber in which at least one of the first powder having a small size is mixed may be coated on the insulating coating 120 and then be cured to form the coating layer 130. The curing may include one of thermal curing and UV curing.

Here, since the liquid silicone rubber base has self-adhesiveness after being cured, the liquid silicone rubber base may be self-adhere to the insulating coating 120 after the liquid silicone rubber base is cured.

The first powder may have a sphere shape. Also, the first powder may have a size of about 10 micron or less, but the present invention is not limited thereto. For example, the more the first powder decreases in size, the more the surface of the coating layer 130 is smooth.

The coating layer 130 may have a thickness of about 3 micron to about 20 micron. If the coating layer 130 is too thin, the coating layer 130 may be easily striped by the friction or abrasion and not provide sufficient elasticity. On the other hand, if the coating layer 130 is too thick, a large amount of relatively expensive materials may be used, and a manufacturing time may increase to increase manufacturing costs.

As described above, the cable 100 may decrease in frictional coefficient and increase in hydrophobic property and hardness by the coating layer 130 which is formed by evenly mixing the first powder in the liquid silicone rubber base.

The coating layer 130 may be electrically insulated. In case of need, the coating layer 130 may have electrical conductivity and thus be used for electrostatic protection. For this, electrical conductive powder such as graphite or carbon nanotube (CNT) may be added to form the coating layer 130. When the coating layer 130 is used for electrostatic protection, the coating layer may have electric resistance of about 103Ω to about 1,010Ω.

To allow the coating layer 130 to reliably adhere to the insulating coating 120, an adhesion reinforcing agent for reinforcing an adhesion force may be added to the liquid silicone rubber, and then, the insulating coating 120 may be impregnated to cure the liquid silicone rubber, thereby forming the coating layer 130.

The coating layer 130 may have a heat-resistant temperature, i.e., a curing temperature equal to or greater than that of the insulating coating 120. For example, the silicone rubber may have a heat-resistant temperature greater than that of the insulating coating 120 formed of a general thermoplastic polymer resin.

However, as described above, since the coating layer 130 has a thickness less than that of the insulating coating 120 to take a relatively short time to perform the coating process, the coating layer 130 having a relatively high heat-resistant temperature may be effectively coated on the insulating coating 120 having a relatively low heat-resistant temperature while minimizing the deformation or decomposition of the insulating coating 120.

The frictional coefficient of the coating layer 130 with respect to the insulating coating 120 may change according to surrounding environments and test conditions. According to this embodiment, under the same environment and test condition, the coating layer 130 may have a frictional coefficient greater by about 5% than that of the insulating coating 120. However, the present invention is not limited thereto.

Also, as described above, the coating layer 130 may have a hydrophobic property greater than that of the insulating coating 120. For example, a water contact angle with respect to the hydrophobic property of the coating layer 130 may be about 100 degrees or more, but the present invention is not limited thereto.

As another example of the manufacturing process, to decrease the frictional coefficient of the coating layer 130, increase the hydrophobic property of the coating layer 130, give superior gloss and luminance to the coating layer 130, and increase mechanical strength of the coating layer 130, at least one of the second powder may be mixed into the liquid silicone rubber base.

The synthetic rubber such as the silicone rubber forming the coating layer 130 may have a refractive index different from that of the second powder mixed therein. Thus, the cable 100 may have the gloss due to the refractive index of the second powder.

To improve the gloss of the coating layer 130, the second powder may be coated with iron oxide or titanium dioxide. The second powder may have a flake shape to improve light reflection and gloss. Also, the second powder may have a thickness of about 5 micron or less, but the present invention is not limited thereto. Here, the more the second powder decreases in thickness, the surface of the cable 100 is smooth.

The second powder may be mixed by about 1 wt % to about 25 w % into the liquid silicone rubber base to form the coating layer 130. Like the first powder, if the second powder content to weight is too much, manufacturing costs may significantly increase, an outer appearance may not be smooth, and the elasticity may be deteriorated. On the other hand, if the second powder content to weight is too less, it may be difficult to decrease the frictional coefficient and increase the hardness.

As further another example of the manufacturing process, at least one of the first powder and at least one of the second powder may be mixed at reasonable rates into the liquid silicone rubber base to cure the liquid silicone rubber base, thereby forming the coating layer 130.

As described above, in the case where the first and second powder may be mixed at reasonable rates into the liquid silicone rubber base to cure the liquid silicone rubber base, thereby forming the coating layer 130, the coating layer 130 of the cable 100 may have a lower frictional coefficient, a higher hydrophobic property, improved hardness, elasticity, high gloss, and an elegant outer appearance.

In this case, as described above, the first and second powder may be mixed by about 1 wt % to about 25 w % into the liquid silicones robber base to form the coating layer 130. However, the present invention is not limited thereto as long as it accords with the purpose of the present invention.

As described above, since the first and second powder are mixed in the coating layer 130, the cable 100 may have various advantages as described above.

Figure 1A:
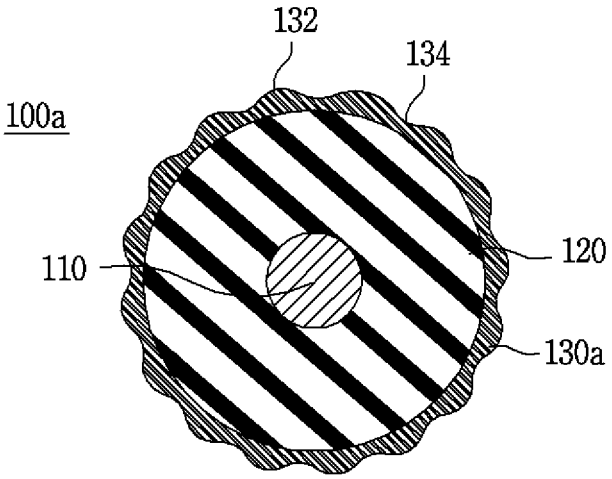
FIG. 1A is a view illustrating a modified example of the cable of FIG. 1.

FIG. 1A is a view illustrating a modified example of the cable of FIG. 1.

According to this embodiment, a coating layer may have a wave shape in which a plurality of rounded mountains and valleys 132 and 134 are alternately repeated along a circumferential direction thereof. That is to say, the coating layer 130*a* may have thicknesses different from each other due to the wave-shaped bent portion thereof.

Therefore, light may be easily reflected and dispersed to provide visual interest. Also, an elastic restoring force may be improved by the bent portion to prevent the coating layer 130*a* from being wrinkled.

The coating layer 130*a* may be manufactured by passing through a mold of which an inner surface has the same shape as the bent portion and then being cured after being impregnated into a liquid polymer.

Figure 2:
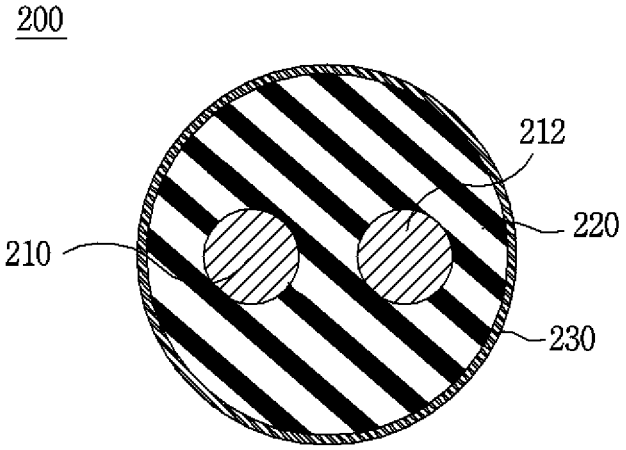
FIG. 2 is a view of a cable according to another embodiment of the present invention.

FIG. 2 is a view of a cable 200 according to another embodiment of the present invention.

The cable 200 includes two metal cores 210 and 212, an insulating coating 220 surrounding the two metal cores 210 and 212, and a coating layer 230 surrounding the insulating coating 220. The pair of metal cores 210 and 212 may be electrically insulated by the insulating coating 220.

Although the two metal cores 210 and 212 are provided in this embodiment, the present invention is not limited thereto. For example, at least three metal cores 210 and 212 may be provided.

The coating layer 230 may not be molten by heat.

Figure 3:
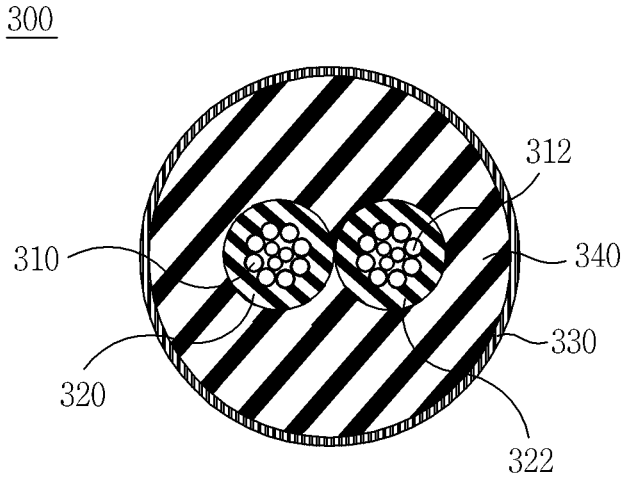
FIG. 3 is a view of a cable according to further another embodiment of the present invention.

FIG. 3 is a view of a cable 300 according to further another embodiment of the present invention.

A cable 300 includes a pair of metal cores 310 and 312 which are respectively provided as stranded wires, insulating coatings 320 and 322 surrounding the metal cores 310 and 312, an insulating jacket 340 surrounding the insulating coatings 320 and 322 at once, and a coating layer 330 surrounding the insulating jacket 340.

The metal cores 310 and 312 are electrically insulated by the insulating coatings 320 and 322 surrounding the metal cores 310 and 312, respectively.

The insulating jacket 340 may be, for example, formed by an extrusion process. The insulating jacket 340 may be formed of the same material as that of the above-described insulating coating 120, and this technology has been well-known. Thus, grains of a polymer resin corresponding to the insulating jacket 340 may be continuously extruded on the insulating coatings 320 and 322 including the metal cores 310 and 312 therein by using an extruder to form the insulating jacket 340.

Here, limitations with respect to the properties of the coating layer 330 and the insulating jacket 340 may be equally applied to those with respect to the coating layer 130 and the insulating coating 120 according to the forgoing embodiment. That is, descriptions with respect to the insulating jacket 340 may be applied to those of the insulation coating 120 according to the forgoing embodiment, and descriptions with respect to the coating layer 330 may be applied to those of the coating layer 130 according to the forgoing embodiment.

That is, the coating layer 330 may have a frictional coefficient less than that of the insulating jacket 340 and a hydrophobic property greater than that of the insulating jacket 340. Also, the coating layer 330 may have a thickness less than that of the insulating jacket 340 and hardness greater than that of the insulating jacket 340.

For this, at least one of first and second powder or the first and second powder may be mixed into the liquid silicone rubber to form the coating layer 330. Also, to decrease the frictional coefficient of the coating layer 330, increase the hydrophobic property of the coating layer 330, and give a gloss to the coating layer 330, second powder may be mixed into a liquid silicone rubber base.

Also, the insulating jacket 340 formed by extrusion may not be applied, but a separate insulating tube may be applied. In this case, the coating layer 330 may adhere to an outer surface of the insulating tube.

As described above, the insulating tube on which the coating layer 330 is formed may be physically fitted onto the insulating coatings 320 and 322.

Figure 4:
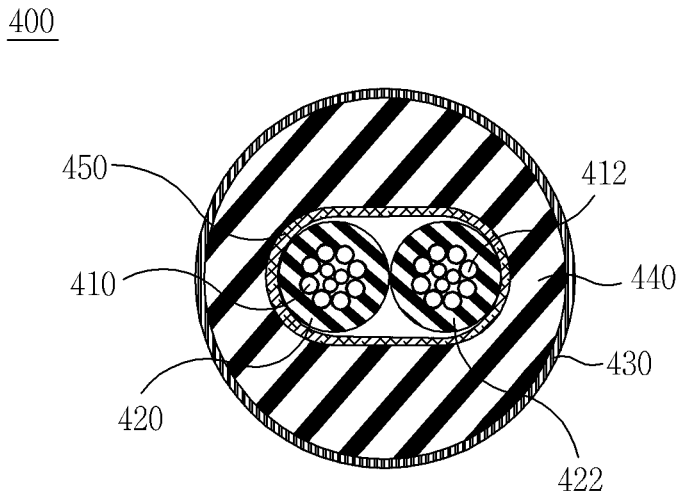
FIG. 4 is a view of a cable according to further another embodiment of the present invention.

FIG. 4 is a view of a cable 400 according to further another embodiment of the present invention.

According to this embodiment, the cable 400 includes a metal core 410, an insulating coating 420 surrounding the metal core 410, a metal shield 450 surrounding the insulating coating 420, an insulating jacket 440 surrounding the metal shield 450, and a coating layer 430 surrounding the insulating jacket 440.

The insulating coating 420 and the insulating jacket 440 may be formed by an extrusion process. Also, each of the insulating coating 420 and the insulating jacket 440 may be formed of the same material as that of each of the above-described insulating coating 120 and insulating jacket 440.

Similarly, limitations with respect to the properties of the coating layer 430 and the insulating jacket 440 may be equally applied to those with respect to the coating layer 130 and the insulating coating 120 according to the forgoing embodiment, and thus, their detailed descriptions will be omitted.

A plurality of metal cores may be sheathed or spirally shielded on the insulating coating 420 or surround a polymer film on which aluminum is formed on one surface thereof to form the metal shield 450.

As known in the related art, the metal shield 450 may block external electromagnetic waves or provide a constant impedence to reduce a loss of an acoustic or image signal when the acoustic or image signal is transmitted. Thus, the cable 400 for transmitting a signal may have superior electrical performance.

As described above, the insulating jacket 440 may be impregnated into liquid silicone rubber, and then the liquid silicone rubber may be cured to form the coating layer 430 disposed on the insulating jacket 440. Through this process, the coating layer 430 may adhere to the insulating jacket 440.

Here, the coating layer 430 may have a thickness less than that of the insulating jacket 440.

Figure 5:
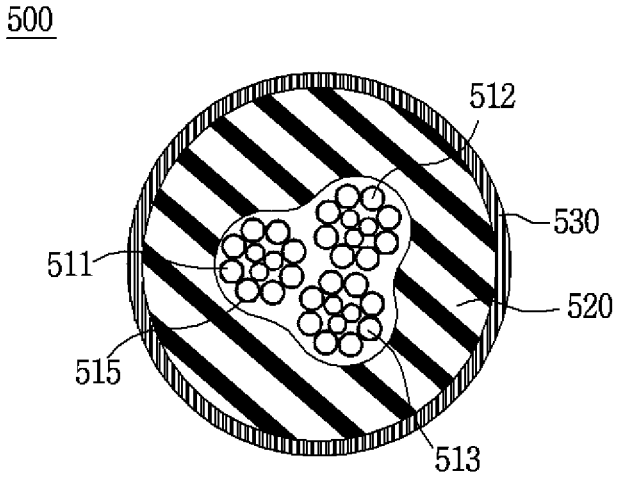
FIG. 5 is a view of a cable according to further another embodiment of the present invention.

FIG. 5 is a view of a cable 500 according to further another embodiment of the present invention.

A cable 500 having a circular shape in section includes a plurality of metal cores 511, 512, and 513 on which an insulating layer 515 is disposed on each of outer surfaces thereof, an insulating coating 520 surrounding the metal cores 511, 512, and 513 at once, and a coating layer 530 surrounding the insulating coating 520.

Similarly, limitations with respect to the properties of the coating layer 530 and the insulating coating 520 may be equally applied to those with respect to the coating layer 130 and the insulating coating 120 according to the forgoing embodiment, and thus, their detailed descriptions will be omitted.

A metal constituting each of the metal cores 511, 512, and 513 may be provided as a single wire or a stranded wire. Also, an insulating material such as enamel may be thinly coated on an outer surface of the single wire or an outer surface of each of single wires constituting the stranded wire to form an insulating layer 515. In this case, the metal cores 511, 512, and 513 may be electrically insulated from each other by the insulating layer 515. Also, the cable 500 may have good flexibility on the whole.

Also, the metal cores 511, 512, and 513 may be utilized by combining metal stranded wires manufactured for each of various kinds of single wires. In this case, at least one of the metal cores 511, 512, and 513 may be a metal core in which metal wires that are a plurality of enamel wires known in the related art are twisted with each other.

Here, one of the metal cores 511, 512, and 513 may be used for electrical grounding and shielding.

According to the above-described structure, since the outermost surface of the cable has the low frictional coefficient, the high hydrophobic property, and the superior elasticity, the cable may not be easily tangled and also be easily untangled even though the cable is tangled. Also, when the cable contacts the user's skin, the cable may provide the smooth feeling. Also, the foreign substances may not be easily attached on the surface of the cable and may be easily detached even though the foreign substances are attached. In addition, since the cable has the superior self-restoring force, the cable may be easily spread even though the cable is crumpled.

Also, since the outermost surface of the cable has the low frictional coefficient, the friction sound due to the friction with the external object may be minimized. Also, the cable may have the high hydrophobic property, and the outermost surface of the cured cable may not be discolored or deformed by the foreign substances.

Also, since the outermost surface of the cable has the high hardness, the cable may not be easily damaged by the contact object.

Also, the coating layer having a thin thickness may be may be continuously reliably attached to only the outermost surface of the cable through the impregnation and curing. Also, since the coating layer is attached to the outermost surface of the cable through the curing, the coating layer may not be easily taken off.

Also, since the coating layer disposed on the outermost surface of the cable is formed of elastic rubber having superior heat-resistance, the heat-resistant temperature of the cable may be improved.

Also, to decrease the frictional coefficient and increase the hydrophobic property, the powder having a low frictional coefficient and a high hydrophobic property may be added to simplify the manufacturing process and reduce the manufacturing costs.

Also, the powder having the gloss may be added to improve the gloss of the outermost surface of the cable and the luminance due to the reflection.

While the present invention has been described in detail, it should be understood that various changes, substitutions and alterations can be made hereto without departing from the spirit and scope of the invention as defined by the appended claims.

For example, since the above-described metal core, insulating coating, and insulating jacket are widely known technologies already, the descriptions with respect to the above-described metal core, insulating coating, and insulating jacket may be merely an example on the basis of the related art, and thus, the scope of the present invention should be determined not with reference to the above description but should, instead, be determined with reference to the following appended claims.

Thus, it will be understood by those of ordinary skill in the art that various changes in form and details may be made therein without departing from the spirit and scope of the present invention as defined by the following claims.

What is claimed is:

1. A cable having reduced tangle ability, the cable comprising:

a metal core for transmitting an electrical signal;

an insulating coating surrounding the metal core, the insulating coating having flexibility; and an elastic coating layer surrounding the insulating coating, the elastic coating layer having flexibility and elasticity, wherein the elastic coating layer is formed from a liquid polymer in which powder is mixed, and the liquid polymer is cured to form the elastic coating layer surrounding the insulating coating, wherein the elastic coating layer has a frictional coefficient less than that of the insulating coating, and a hydrophobic property greater than that of the insulating coating.

2. The cable of claim 1, wherein the liquid polymer is liquid synthetic rubber.

3. The cable of claim 2, wherein the liquid synthetic rubber is selected from one of silicone-based rubber, urethane-based rubber, olefin-based rubber, and styrene-based rubber.

4. The cable of claim 1, wherein the powder includes first powder selected from the group consisting of 3D cross-linked silicone powder, polymethyl methacrylate (PMMA) powder, ceramic powder, fluorine power, and monodispersed polystyrene, and second powder selected from the group consisting of mica powder, silica powder, glass powder, graphite powder, and alumina powder.

5. The cable of claim 4, wherein the first powder has a sphere shape, and the second powder has a flake shape.

6. The cable of claim 4, wherein the second powder is coated with iron oxide or titanium dioxide.

7. The cable of claim 4, wherein the liquid polymer after being cured comprises synthetic rubber, wherein the synthetic rubber has a refractive index different from that of the second powder, and the cable has a gloss due to the refractive index difference.

8. The cable of claim 1, wherein the elastic coating layer has a thickness less than that of the insulating coating, and the coating layer has a heat-resistant temperature greater than that of the insulating coating.

9. The cable of claim 1, wherein the elastic coating layer has hardness greater than that of the insulating coating.

10. The cable of claim 1, wherein the metal core comprises one of a metal single wire and a metal stranded wire in which a plurality of metal single wires are twisted with each other.

11. The cable of claim 1, wherein the metal core comprises a metal single wire on which an insulating layer is formed on an outer surface thereof by enamel coating or a metal stranded wire in which a plurality of metal single wires are twisted with each other.

12. The cable of claim 1, wherein one insulating coating surrounds one metal core or a plurality of metal cores which are insulated from each other, or each of a plurality of insulating coatings surrounds one metal core or each of a plurality of metal cores which are insulated from each other.

13. The cable of claim 1, wherein the metal core is surrounded by an insulating thread, or the insulating thread is parallely arranged adjacent to the metal core.

14. The cable of claim 1, wherein the coating layer has electrical insulation or electrical semiconductivity.

15. The cable of claim 1, wherein the cable is a cable for earphones exposed to the outside for use, a cable for measuring instruments, a cable for robots, or a cable for computers.

16. The cable of claim 1, wherein the elastic coating layer has a wave shape in which a plurality of rounded mountains and valleys are alternately repeated along a circumferential direction thereof.

17. A cable having reduced tangle ability, the cable comprising:

at least one metal core for transmitting an electrical signal;

at least one insulating coating surrounding the metal core, the insulating coating having flexibility;

an insulating jacket surrounding the insulating coating, the insulating jacket having flexibility; and an elastic coating layer surrounding the insulating jacket, the elastic coating layer having flexibility, wherein the elastic coating layer is formed from a liquid polymer resin in which powder is mixed, and the liquid polymer resin is cured to form the elastic coating layer surrounding the insulating jacket, wherein the elastic coating layer has a frictional coefficient less than that of the insulating jacket, and a hydrophobic property greater than that of the insulating jacket.

18. The cable of claim 17, further comprising a metal shield surrounding the insulating coating between the insulating coating and the insulating jacket.

19. The cable of claim 17, wherein the insulating jacket is formed by continuously extruding on the insulating coating or comprises a separate insulating tube.

20. The cable of claim 19, wherein the insulating tube is fitted onto the insulating coating.

21. The cable of claim 17, wherein the liquid polymer is liquid synthetic rubber.

22. The cable of claim 21, wherein the liquid synthetic rubber is selected from one of silicone-based rubber, urethane-based rubber, olefin-based rubber, and styrene-based rubber.

23. The cable of claim 17, wherein the powder includes first powder selected from the group consisting of 3D cross-linked silicone powder, polymethyl methacrylate (PMMA) powder, ceramic powder, fluorine power, and monodispersed polystyrene, and second powder selected from the group consisting of mica powder, silica powder, glass powder, graphite powder, and alumina powder.

24. The cable of claim 23, wherein the first powder has a sphere shape, the second powder has a flake shape.

25. The cable of claim 23, wherein the second powder is coated with iron oxide or titanium dioxide.

26. The cable of claim 23, wherein the liquid polymer after being cured comprises synthetic rubber, wherein the synthetic rubber has a refractive index different from that of the second powder, and the cable has a gloss due to the refractive index difference.

27. The cable of claim 17, wherein the elastic coating layer has a thickness less than that of the insulating jacket, and the elastic coating layer has a heat-resistant temperature greater than that of the insulating jacket.

28. The cable of claim 17, wherein the elastic coating layer has hardness greater than that of the insulating jacket.

29. The cable of claim 17, wherein the metal core is provided in plurality, wherein the insulating coating surrounds each of the metal cores or the metal cores at once, and the insulating jacket surrounds the insulating coating at once.

30. The cable of claim 17, wherein the elastic coating layer has electrical semiconductivity.

31. The cable of claim 17, wherein the cable is a cable for earphones exposed to the outside for use, a cable for measuring instruments, a cable for robots, or a cable for computers.

32. The cable of claim 17, wherein the elastic coating layer has a wave shape in which a plurality of rounded mountains and valleys are alternately repeated along a circumferential direction thereof.

* * * * *